United States Patent [19]

Kawaguchi

[11] Patent Number: 4,625,192

[45] Date of Patent: Nov. 25, 1986

[54] SUPERCONDUCTING APPARATUS WITH IMPROVED CURRENT LEAD-IN

[75] Inventor: Takeo Kawaguchi, Akashi, Japan

[73] Assignee: Mitsubishi Denki Kabushiki Kaisha, Tokyo, Japan

[21] Appl. No.: 703,411

[22] Filed: Feb. 20, 1985

[30] Foreign Application Priority Data

Feb. 20, 1984 [JP] Japan ..... 59-28747

[51] Int. Cl.[4] ..... H01B 17/26; H01B 17/36; H01F 7/24

[52] U.S. Cl. ..... 335/216; 174/15 BH; 174/15 CA; 174/152 R

[58] Field of Search ..... 174/15 BH, 15 CA, 16 BH, 174/18, 152 R, 152 E, 152 G, 31 R, 50, 56, 142, 153 R; 335/216

[56] References Cited

U.S. PATENT DOCUMENTS 2,441,457 5/1948 Treanor ..... 174/152 R X

FOREIGN PATENT DOCUMENTS 484597 3/1976 U.S.S.R. ..... 174/15 BH

OTHER PUBLICATIONS

Katheder, H., et al., "Design and Test of a 10 KA Gas--Cooled Current-Lead for Superconducting Magnets", *IEEE Transactions on Magnetics*, vol. MAG-17, No. 5, Sep. 1981, pp. 2071-2074.

*Primary Examiner*—Laramie E. Askin

*Attorney, Agent, or Firm*—Leydig, Voit & Mayer, Ltd.

[57] ABSTRACT

A superconducting apparatus comprises a superconducting coil, a cryogenic fluid for cooling the coil, a vessel for enclosing the superconducting coil and the cryogenic fluid, a current lead penetrating into and supported by the vessel and electrically connected to the superconducting coil, and an electrically insulating tube disposed around the current lead. The insulating tube includes an electrically insulating ring disposed around the current lead between the vessel and the current lead and outside of the vessel for electrically insulating and hermetically sealing between the current lead and the vessel, a hollow electrically insulating cylinder disposed around the current lead, and means disposed between the insulating ring and the cylinder for continuously connecting the ring and the cylinder thereby to substantially close any gap therebetween against electrical discharges therethrough.

1 Claim, 3 Drawing Figures

SUPERCONDUCTING APPARATUS WITH IMPROVED CURRENT LEAD-IN

BACKGROUND OF THE INVENTION

This invention relates to a superconducting apparatus, and particularly to a superconducting apparatus including a current lead penetrating through a thermally insulating vessel.

FIGS. 1 and 2 show the structure of a conventional, typical super conducting magnet wherein a superconducting coil 1 is supplied with current through a current lead 2 and a connecting lead 3. A thermally insulating vessel 4 for enclosing a cryogenic liquid to cool a superconducting coil 1 comprises a vessel body 4*a* and a lid 4*b*. The lid 4*b* mechanically fixed on the vessel 4 shields the atmosphere inside the vessel from the outside atmosphere. The current lead 2 penetrates into and is supported by the lid 4*b* which is also provided with piping and the like (not shown). Liquid helium 6 is stored within the vessel body 4*a*. Immersing the superconducting coil 1 into liquid helium cools the coil 1 to cryogenic temperatures (about −269 degrees Celsius) and a superconducting state. Helium gas 7 fills the upper space of the vessel 4. A plurality of baffle boards 8 are provided to reduce the heat penetration from the lid 4*b*.

The withstand voltage insulation between the top portion of the current lead 2 and the lid 4*b* is maintained by an insulating ring 9 disposed in a normal temperature region and a gasket 10 mounted between the current lead 2 and the insulating ring 9. The insulating ring 9 and the lid 4*b* also form a seal between the atmosphere inside the vessel and the outside air. Insulating papers 11 and 12 are respectively is wound around the current lead 2 and the connecting lead 3 to maintain the withstand voltage insulation thereof. The unnumbered arrows indicate the direction of flow of helium gas 7. The current flowing into the current lead 2 causes a resistance loss. Generally, the current lead 2 has a bore (not shown) extending therethrough for cooling the current lead 2 by the flow of helium gas through the bore.

However, in the prior art construction of the current lead 2, the insulating ring 9 and the insulating paper 11 are distinct members separated from one another, so a portion of the current lead 2 is exposed to warmed helium having a low withstand voltage, and electrical discharges sometimes occur between the current lead 2 and the lid 4*b*. Furthermore, in the conventional superconducting magnet of the above construction, the insulating ring 9 is disposed at a sealing portion between the inside atmosphere of the vessel and the outside atmosphere, and the withstand voltage of helium gas 7 inside the vessel is only a fraction of the withstand voltage of air at normal temperatures (about 20 degrees Celsius). Therefore, if the helium temperature inside the vessel near the insulating ring 9 rises up to the temperature (about 20 degrees Celsius) of the outside atmosphere, electrical discharges may occur between the current lead 2 and the lid 4*b*, and between the current lead 2 and the baffle boards 8.

Furthermore, since the connecting lead is covered by the insulating paper 12, there is the disadvantage that the connecting lead 3 is prevented from heat radiation and the temperature thereof rises.

SUMMARY OF THE INVENTION

Accordingly, an object of the present invention is to provide a superconducting apparatus in which the above-mentioned drawbacks of the conventional design are eliminated.

Another object of the present invention is to provide a superconducting apparatus in which electrical discharge cannot occur between the current lead and the lid of the apparatus or between the current lead and the baffle boards.

Another object of the present invention is to provide a superconducting apparatus in which discharge cannot occur between the current lead and the lid of the vessel or between the current lead and the baffle boards, and in which the current lead is more efficiently cooled than in a conventional apparatus.

A further object of the invention is to provide a superconducting apparatus in which a current lead and a connecting lead can be effectively insulated without the need to use insulating paper.

With the above objects in view, a superconducting apparatus of the present invention comprises a superconducting coil, a cryogenic fluid for cooling the coil, a vessel for enclosing the superconducting coil and the cryogenic fluid, a current lead penetrating into and supported by the vessel and electrically connected to the superconducting coil, and an electrically insulating tube disposed around the current lead. The insulating tube includes an electrically insulating ring disposed around the current lead between the vessel and the current lead and outside of the vessel for electrically insulating and hermetically sealing between the current lead and the vessel, a hollow electrically insulating cylinder disposed around the current lead, and means disposed between the insulating ring and the cylinder for continuously connecting the ring and the cylinder thereby to substantially close any gap therebetween against electrical discharges therethrough.

BRIEF DESCRIPTION OF THE DRAWINGS

The invention will become more readily apparent from the following detailed description of the preferred embodiment of the invention taken in conjunction with the accompanying drawings, in which.

PREFERRED EMBODIMENT OF THE INVENTION

Figure 1:
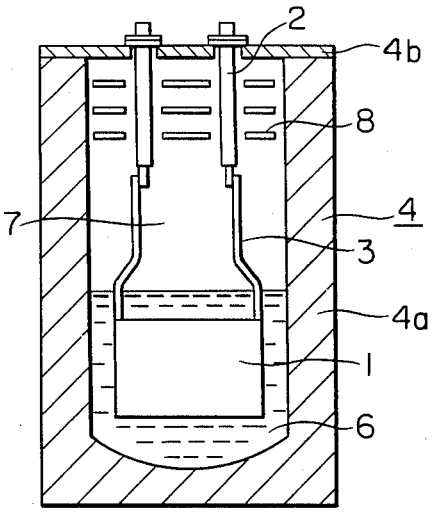
FIG. 1 PRIOR ART
FIG. 1 is a vertical sectional view showing the construction of a superconducting apparatus to which the present invention can be applied.
Figure 2:
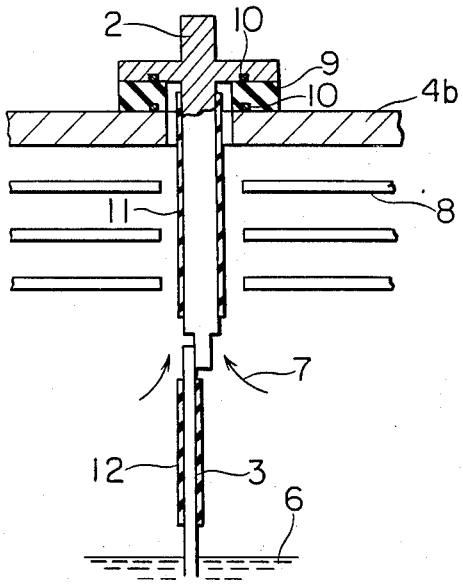
FIG. 2 PRIOR ART
FIG. 2 is a vertical sectional view of a current lead of a conventional design.

An embodiment of the present invention will now be explained while referring to FIG. 3. Reference numerals identical to those used in FIGS. 1 and 2 indicate corresponding parts, and accordingly an explanation thereof will not be necessary. In the embodiment shown in FIG. 3, it is seen that the current lead 2 is surrounded by a hollow electrically insulating tube 13 made, for example, of an electrically insulating plastic. The insulating tube 13 comprises an electrically insulating ring 13*a* disposed around the current lead 2 and between the vessel lid 4*b* and the flange 2*a* of the current lead 2 outside of the vessel 4. The insulating ring 13*a* electrically insulates the current lead 2 from the lid 4*b* of the vessel 4. Also, the insulating ring 13*a* fluid-tightly seals between the flange 2*a* of the current lead 2 and the vessel lid 4*b*, in cooperation with O-rings 10 disposed between the flange 2*a* and the insulating ring 13*a* and between the insulating ring 13*a* and the vessel lid 4*b*. The insulating tube 13 also comprises a hollow electrically insulating cylinder 13*b* disposed around the current lead 2, and a connecting portion 13*c* disposed between the insulating ring 13*a* and the cylinder 13*b* for continuously connecting the ring 13*a* and the cylinder 13*b*. The insulating cylinder 13*b* is supported from the insulating ring 13*a* by the connecting portion 13*c* and downwardly extends from the ring 13*a* to cover the inner portion of the current lead 2 and a substantial portion of the connecting lead 3. In the illustrated embodiment, the insulating tube 13 is an integral member, so that the ring 13*a*, the cylinder 13*b* and the connecting portion 13*c* are formed in one piece. The connecting portion 13*c* continuously connects the insulating ring 13*a* and the cylinder 13*b* so that no gap or clearance is formed therebetween to substantially close this area against electrical discharges therethrough. It is to be noted that an annular space 14 is provided within the insulating cylinder 13*b* for allowing the flow of helium gas 7 to enter therein to efficiently cool the current lead 2 and the connecting lead 3.

Using the insulating tube 13 of the invention results in increasing a withstand voltage between the current lead 2 and the vessel lid 4*b*, and between the current lead 2 and the baffle boards 8 because the current lead 2 is not directly exposed to the the vessel lid 4*b*.

Figure 3:
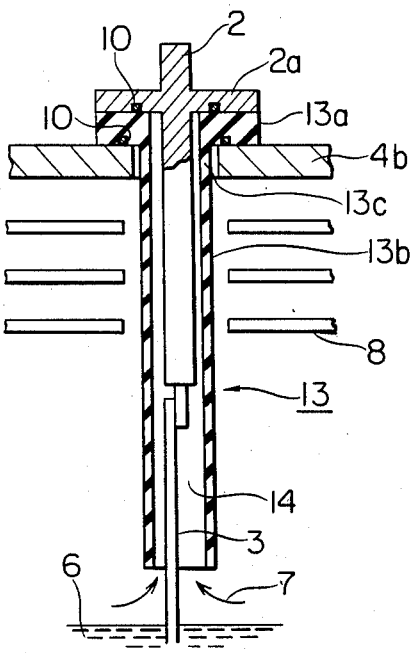
FIG. 3 is a vertical sectional view of a current lead of a superconducting apparatus of the present invention.

Although the insulating tube 13 in FIG. 3 is cylindrical in form, other cross-sectional shapes may be used with the same effect. Furthermore, the insulating tube 13 need not surround the connecting lead 3. Also, although the insulating ring 13*a*, the cylinder 13*b* and the connecting portion 13*c* are shown as being integrally formed, they may be separately constructed.

As described above, the present invention provides a higher performance superconducting apparatus having a current lead with a high withstand voltage by providing a hollow insulating tube which prevents electrical discharge between the current lead and the vessel lid or the like. Also, since the current lead can be cooled by helium gas flow passing through the hollow insulating tube, the cooling efficiency is greatly improved.

What is claimed is:

1. In a superconducting apparatus comprising a superconducting coil, a cryogenic fluid for cooling said coil, a vessel enclosing said superconducting coil and said cryogenic fluid, a current lead penetrating from outside into and being supported by said vessel and electrically connected to said superconducting coil and having a radially extending flange, the improvement comprising an insulating tube including an electrically insulating ring disposed around said current lead substantially coextensive with said flange between said vessel and said flange of said current lead outside of said vessel for electrically insulating between said current lead and said vessel, sealing rings for hermetically sealing between said ring and both said flange and said vessel, a hollow electrically insulating cylinder disposed around said current lead, and an electrically insulating cylindrical connection disposed between said insulating ring and said cylinder for integrally connecting said ring and said cylinder, thereby to substantially close any gap therebetween against electrical discharges therethrough; said ring, cylindrical connection and cylinder being formed as a unitary plastic member defining a sealed gas passage between said cylinder and said current lead for cooling said current lead.

* * * * *